US008778866B2

(12) United States Patent
Fernandez Martinez et al.

(10) Patent No.: US 8,778,866 B2
(45) Date of Patent: Jul. 15, 2014

(54) CONTINUOUS PROCESS OF MAKING A FABRIC SOFTENER COMPOSITION

(71) Applicant: The Procter & Gamble Company, Cincinnati, OH (US)

(72) Inventors: Lucia Fernandez Martinez, Brussels (BE); Omer Erbezci, Brussels (BE); Hugo Jean Marie Demeyere, Brussels (BE); Etienne Maria Betty Andre Jeuniaux, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 54 days.

(21) Appl. No.: 13/655,485

(22) Filed: Oct. 19, 2012

(65) Prior Publication Data

US 2013/0102519 A1 Apr. 25, 2013

Related U.S. Application Data

(60) Provisional application No. 61/549,311, filed on Oct. 20, 2011.

(51) Int. Cl.
*C11D 1/645* (2006.01)

(52) U.S. Cl.
USPC ..... 510/527; 510/522

(58) Field of Classification Search
USPC ..... 510/522, 527
See application file for complete search history.

(56) References Cited

U.S. PATENT DOCUMENTS

| | | | | |
|---|---|---|---|---|
| 3,516,941 | A | 6/1970 | Matson | |
| 4,145,184 | A | 3/1979 | Brain et al. | |
| 4,234,627 | A | 11/1980 | Schilling | |
| 4,514,461 | A | 4/1985 | Woo | |
| 4,520,142 | A | 5/1985 | Leinen | |
| 4,528,226 | A | 7/1985 | Sweeny | |
| 4,681,806 | A | 7/1987 | Matkan et al. | |
| RE32,713 | E | 7/1988 | Woo | |
| 4,882,220 | A | 11/1989 | Ono et al. | |
| 4,917,920 | A | 4/1990 | Ono et al. | |
| 5,411,671 | A * | 5/1995 | Bauer et al. | 510/522 |
| 5,500,137 | A | 3/1996 | Bacon et al. | |
| 5,500,138 | A | 3/1996 | Bacon et al. | |
| 5,500,154 | A | 3/1996 | Bacon et al. | |
| 5,652,205 | A | 7/1997 | Hartman et al. | |
| 5,780,404 | A | 7/1998 | Bacon et al. | |
| 6,180,594 | B1 * | 1/2001 | Fender et al. | 510/527 |
| 6,200,949 | B1 | 3/2001 | Reijmer et al. | |
| 6,491,728 | B2 | 12/2002 | Bacon et al. | |
| 6,645,479 | B1 | 11/2003 | Shefer et al. | |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |

(Continued)

FOREIGN PATENT DOCUMENTS

| | | | |
|---|---|---|---|
| EP | 1 393 706 | A1 | 5/2004 |
| GB | 2 073 132 | A | 10/1981 |
| WO | WO 99/17871 | A1 | 4/1999 |

*Primary Examiner* — John Hardee

(74) *Attorney, Agent, or Firm* — James F. McBride; Steven W. Miller

(57) ABSTRACT

A continuous process of making a fabric softener composition comprising di(C6-C14)alkyl di(C1-C4 alkyl and/or hydroxyalkyl) quaternary and perfume, and a fabric softener composition obtained by the continuous process. The fabric softener composition obtained by the continuous process demonstrates a stable viscosity, especially while being stored for a prolonged period of time.

10 Claims, 4 Drawing Sheets

(56) References Cited

U.S. PATENT DOCUMENTS

| | | | |
|---|---|---|---|
| 2003/0203829 | A1 | 10/2003 | Shefer et al. |
| 2003/0215417 | A1 | 11/2003 | Uchiyama et al. |
| 2003/0216488 | A1 | 11/2003 | Uchiyama et al. |
| 2004/0071742 | A1 | 4/2004 | Popplewell et al. |
| 2004/0071746 | A1 | 4/2004 | Popplewell et al. |
| 2004/0072719 | A1 | 4/2004 | Bennett et al. |
| 2004/0072720 | A1 | 4/2004 | Brain et al. |
| 2004/0087477 | A1 | 5/2004 | Ness |
| 2004/0106536 | A1 | 6/2004 | Mane et al. |
| 2007/0275866 | A1 | 11/2007 | Dykstra |
| 2011/0172137 | A1* | 7/2011 | Corominas et al. ..... 510/527 |
| 2011/0245143 | A1 | 10/2011 | Zerhusen |

* cited by examiner

CONTINUOUS PROCESS OF MAKING A FABRIC SOFTENER COMPOSITION

FIELD OF THE INVENTION

The present invention relates to a continuous process of making a fabric softener composition. The present invention also relates to a fabric softener composition obtained by the continuous process.

BACKGROUND OF THE INVENTION

Di(C6-C14)alkyl di(C1-C4 alkyl and/or hydroxyalkyl) quaternary has been used in household products, such as air care products, laundry detergent products, and fabric softener products, for several years. In such products, di(C6-C14) alkyl di(C1-C4 alkyl and/or hydroxyalkyl) quaternary delivers an anti-microbial benefit.

In terms of production process, currently fabric softener products including di(C6-C14)alkyl di(C1-C4 alkyl and/or hydroxyalkyl) quaternary are prepared in a batch process. Indeed, in such a batch step, different ingredients are added into a mix tank and then mixed. After the mixing period, follow-up steps in the production process, e.g., transporting the mixture of the ingredients to the packing lines, have to be performed. Moreover, when producing a different product having a different formulation, even for only slight formulation changes, the mix tank has to be rinsed, which requires the production process to be interrupted. In conclusion, batch production processes for making fabric softener products are generally considered inefficient and time-consuming.

Recently, continuous production processes for fabric softener products have been introduced. In a typical continuous process, such as an in-line process, base ingredients that constitute the main part of the fabric softener product, e.g., fabric softener active composition, flow through a line, and finishing ingredients, e.g., dye, perfume, silicone, etc., are added into the flow, to form the finished product. Moreover, in the in-line process, different fabric softener products with different finishing ingredients can be made by adjusting the addition of related finishing ingredients without a pause or stop. In conclusion, continuous processes for making fabric softener products are generally considered more efficient and less time-consuming as compared to batch processes. In view thereof, it is preferred to make fabric softener products using a continuous process rather than by a batch process.

However, it has been found that when di(C6-C14)alkyl di(C1-C4 alkyl and/or hydroxyalkyl) quaternary is formulated together with perfume into fabric softener active compositions in a continuous process, the finished fabric softener compositions become unstable due to an increase of viscosity, especially while being stored for a prolonged period of time.

Thus, there is a need for a continuous process for making a stable fabric softener composition comprising di(C6-C14) alkyl di(C1-C4 alkyl and/or hydroxyalkyl) quaternary and perfume. Indeed, it is the objective of the present invention to establish a continuous process for making a stable fabric softener composition comprising di(C6-C14)alkyl di(C1-C4 alkyl and/or hydroxyalkyl) quaternary and perfume.

It has been found that this objective can be met by the process according to the present invention. Specifically, the present invention provides a continuous process of making a fabric softener composition comprising di(C6-C14)alkyl di(C1-C4 alkyl and/or hydroxyalkyl) quaternary and perfume, wherein the viscosity of the fabric softener composition remains stable upon storage.

It is an advantage of the present invention to provide a continuous process of making a stable fabric softener composition comprising perfume and relatively high levels of di(C6-C14)alkyl di(C1-C4 alkyl and/or hydroxyalkyl) quaternary, e.g., more than 0.30% by weight of the fabric softener composition.

It is a further advantage of the present invention to provide a continuous process of making a stable fabric softener composition comprising perfume and relatively low levels of di(C6-C14)alkyl di(C1-C4 alkyl and/or hydroxyalkyl) quaternary, e.g., less than 0.23% by weight of the fabric softener composition, whereas in a certain portion of the process, the di(C6-C14)alkyl di(C1-C4 alkyl and/or hydroxyalkyl) quaternary may reach a high concentration.

SUMMARY OF THE INVENTION

The present invention relates to a continuous process of making a fabric softener composition, wherein the process comprises the steps of:

a) adding a di(C6-C14)alkyl di(C1-C4 alkyl and/or hydroxyalkyl) quaternary in an amount of 0.01% to 1% by weight of the fabric softener composition and a perfume to a fabric softener active composition comprising 2% to 25% by weight of the fabric softener active composition of a bis-(2-hydroxyethyl)-dimethylammonium chloride fatty acid ester; and b) mixing the combination obtained in step a) by applying a shear of 1000 to 50000 $s^{-1}$, wherein in step a) the perfume and the di(C6-C14)alkyl di(C1-C4 alkyl and/or hydroxyalkyl) quaternary are added separately.

The present invention further relates to a fabric softener composition obtained by the process.

DETAILED DESCRIPTION OF THE INVENTION

Definitions

Figure 1:
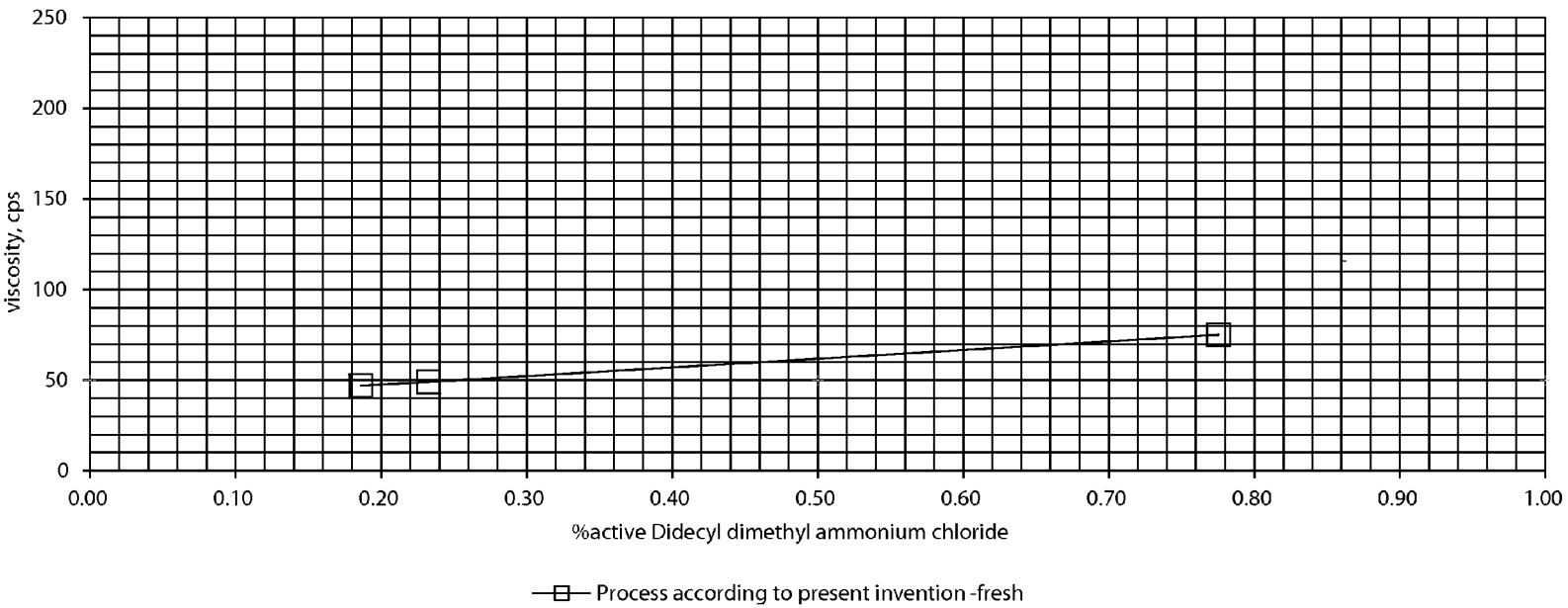
FIG. 1 is graph showing the experimental results for the inventive sample before aging according to Examples 3-14 herein.
Figure 2:
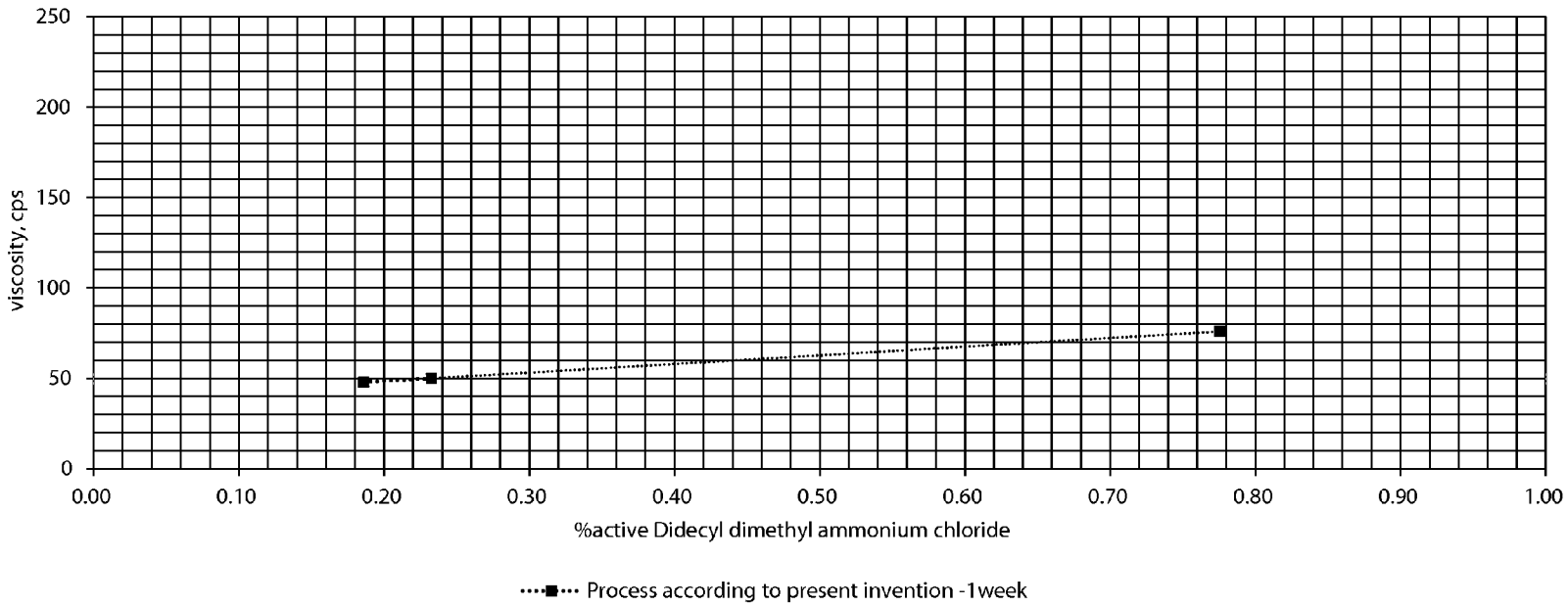
FIG. 2 is graph showing the experimental results for the inventive sample after aging according to Examples 3-14 herein.
Figure 3:
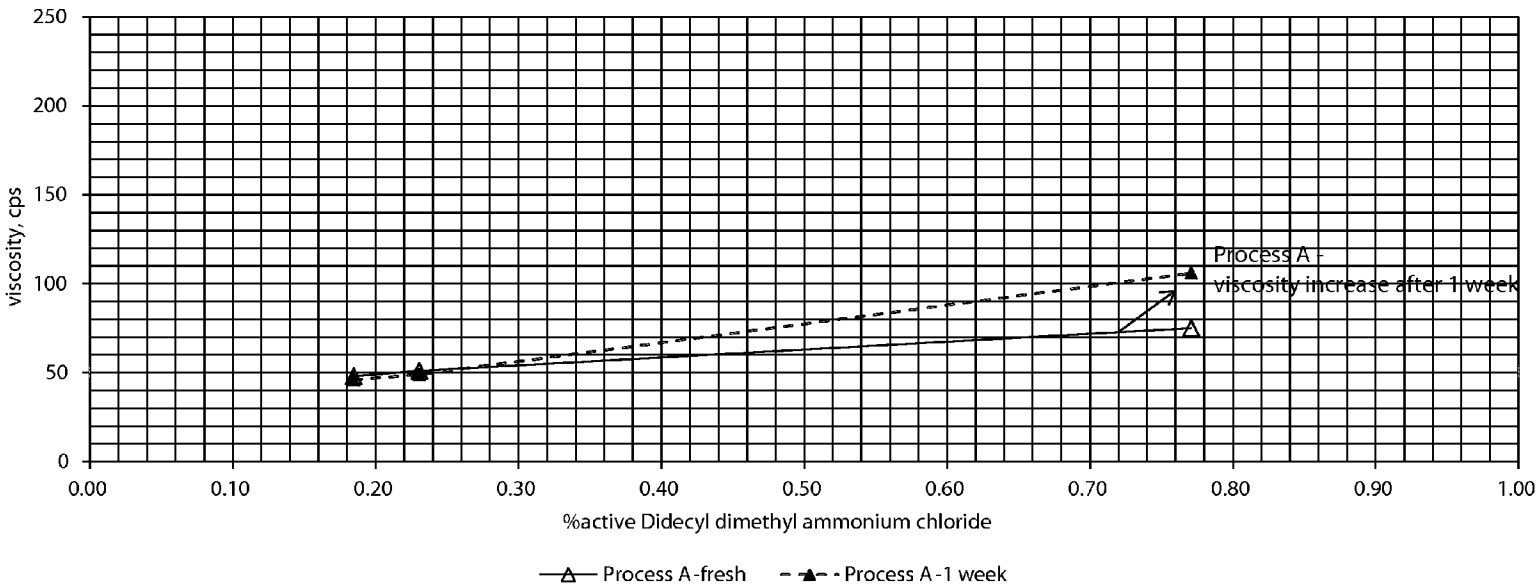
FIG. 3 is graph showing the experimental results for Process A according to Examples 3-14 herein.
Figure 4:
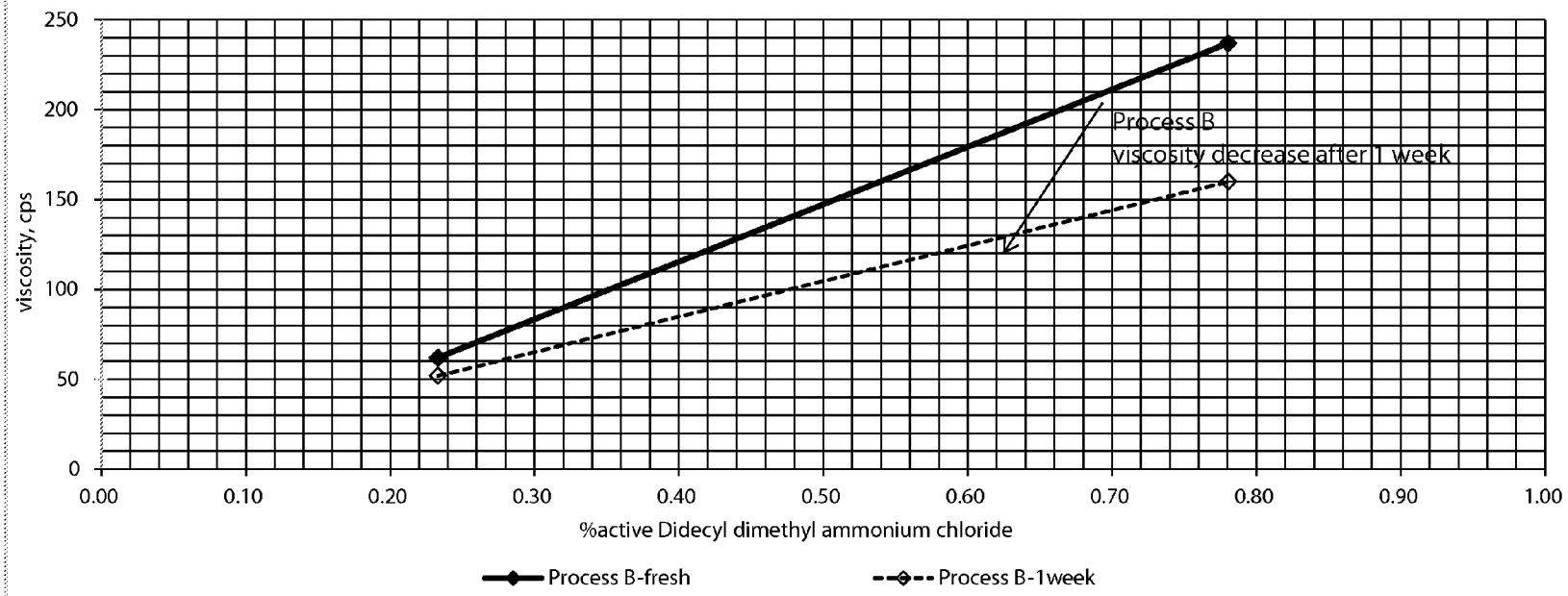
FIG. 4 is graph showing the experimental results for and Process B according to Examples 3-14 herein.

As used herein, the term "fabric softener product" means a product that comprises a fabric softener composition and delivers a fabric softening benefit to fabrics. In addition to the fabric softening benefit, fabric softener products may be able to deliver one or more of the following benefits to fabrics as well: fabric lubrication, fabric relaxation, wrinkle resistance, wrinkle reduction, durable press, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance, and mixtures thereof. The fabric softener products include various tablet, granular, liquid and rinse-aids, sprays and mists, and substrate-laden types for fabrics; as well as substrate-laden products such as dryer added sheets, dry and wetted wipes and pads, and nonwoven substrates.

As used herein, the term "fabric softener active composition" means a composition that constitutes the main part of a fabric softener product. The fabric softener active composition generally comprises fabric softener actives and water, wherein the fabric softener actives deliver the function of softening fabrics.

As used herein, the term "alkyl" means a hydrocarbyl moiety which is straight or branched, saturated or unsaturated. Included in the term "alkyl" is the alkyl portion of acyl groups.

As used herein, the term "continuous" means uninterrupted extension in time, sequence, or space, without a break.

As used herein, the term "separate" means being kept apart.

As used herein, the term "combination" refers to materials added together with or without substantial mixing towards achieving homogeneity.

As used herein, the term "mix" refers to adding materials together and achieving homogeneity, and the term "mixture" refers to mixed materials achieving homogeneity.

As used herein, the term "batch process" refers to a process, during which different ingredients are added into a mix tank and then mixed.

As used herein, the term "base ingredients" refers to an ingredient or material that is employed as a sub-formulation and/or intermediate.

As used herein, the term "finishing ingredients" is intended to be mixed with at least one base ingredient to produce a product that may be an intermediate or a finished product.

As used herein, the term "in-line process" refers to a process, during which base ingredients flow through a line and finishing ingredients are added into the flow, to form finished products.

As used herein, the terms "emulsify", "emulsified", and "emulsification" refer to mixing two or more liquids that are normally immiscible.

As used herein, the articles including "a" and "an" when used in a claim, are understood to mean one or more of what is claimed or described.

As used herein, the terms "comprise" "comprises" "comprising" "include", "includes", and "including" are meant to be non-limiting, i.e., other steps and other ingredients which do not affect the end of result can be added. The above terms encompass the terms "consisting of" and "consisting essentially of".

Fabric Softener Composition

The fabric softener composition obtained according to the continuous process of the present invention comprises a fabric softener active composition that comprises a bis-(2-hydroxyethyl)-dimethylammonium chloride fatty acid ester, a di(C6-C14)alkyl di(C1-C4 alkyl and/or hydroxyalkyl) quaternary, and a perfume. Preferably, the fabric softener composition herein comprises one or more adjunct materials.

Fabric Softener Active Composition

The continuous process of the present invention comprises the step of adding a di(C6-C14)alkyl di(C1-C4 alkyl and/or hydroxyalkyl) quaternary to a fabric softener active composition comprising 2% to 23% by weight of the fabric softener active composition of a bis-(2-hydroxyethyl)-dimethylammonium chloride fatty acid ester for softening fabrics. Preferably, the fabric softener active composition comprises 7% to 20%, preferably 10% to 18%, more preferably 15% to 18%, by weight of the fabric softener active composition, of the bis-(2-hydroxyethyl)-dimethylammonium chloride fatty acid ester.

In a preferred embodiment, the fabric softener composition comprises 1% to 20%, preferably 3% to 15%, more preferably 5% to 11%, by weight of the fabric softener composition, of the bis-(2-hydroxyethyl)-dimethylammonium chloride fatty acid ester.

In another embodiment, the bis-(2-hydroxyethyl)-dimethylammonium chloride fatty acid ester has an average chain length of the fatty acid moieties of from 16 to 20 carbon atoms, preferably from 16 to 18 carbon atoms, and an Iodine Value (IV), calculated for the free fatty acid, of from 15 to 25, preferably from 18 to 22, more preferably from 9 to 21. The Iodine Value is the amount of iodine in grams consumed by the reaction of the double bonds of 100 g of fatty acid, as determined by the method of ISO 3961.

The fabric softener active composition herein may comprise other materials in addition to the bis-(2-hydroxyethyl)-dimethylammonium chloride fatty acid ester. Non limiting examples include water, salt (e.g., $CaCl_2$), acid (e.g., HCl and formic acid).

In another embodiment, the fabric softener active composition has a pH of from 2 to 5, preferably from 2.5 to 4, more preferably from 2.5 to 3.5. The pH may be adjusted with the use of hydrochloric acid or formic acid.

Di(C6-C14)Alkyl Di(C1-C4 Alkyl and/or Hydroxyalkyl) Quaternary

The continuous process of the present invention comprises the step of adding a di(C6-C14)alkyl di(C1-C4 alkyl and/or hydroxyalkyl) quaternary in an amount of 0.01% to 1% by weight of the fabric softener composition to the fabric softener active composition. Preferably, the fabric softener composition comprises 0.01% to 1%, preferably 0.1% to 0.78%, more preferably 0.23% to 0.3%, by weight of the fabric softener composition, of the di(C6-C14)alkyl di(C1-C4 alkyl and/or hydroxyalkyl) quaternary comprises.

Preferred examples of the di(C6-C14)alkyl di(C1-C4 alkyl and/or hydroxyalkyl) quaternary are di(C8-C12)alkyl dimethyl ammonium chloride. More preferred examples include didecyl dimethyl ammonium chloride such as Bardac® 2250 and dioctyl dimethyl ammonium chloride such as Bardac® 2050, both of which are available from Lonza. The most preferred example of the di(C6-C14)alkyl di(C1-C4 alkyl and/or hydroxyalkyl) quaternary is didecyl dimethyl ammonium chloride.

The di(C6-C14)alkyl di(C1-C4 alkyl and/or hydroxyalkyl) quaternary delivers an anti-microbial benefit. Without wishing to be bound by theory, when rinsing fabrics with the fabric softener composition comprising the di(C6-C14)alkyl di(C1-C4 alkyl and/or hydroxyalkyl) quaternary, the di(C6-C14) alkyl di(C1-C4 alkyl and/or hydroxyalkyl) quaternary tends to deposit on fabrics due to its positive charge. Afterwards, the di(C6-C14)alkyl di(C1-C4 alkyl and/or hydroxyalkyl) quaternary attracts negative charge of cell membrane, disrupts it, and denatures proteins or enzymes that are critical to grow. Thus, the di(C6-C14)alkyl di(C1-C4 alkyl and/or hydroxyalkyl) quaternary prevents germ growth on fabrics.

Perfume

The continuous process of the present invention comprises the step of adding a perfume to the fabric softener active composition. As used herein, the term "perfume" includes fragrant substance or mixture of substances including natural (i.e., obtained by extraction of flowers, herbs, leaves, roots, barks, wood, blossoms or plants), artificial (i.e., a mixture of different nature oils or oil constituents), and synthetic (i.e., synthetically produced) odoriferous substances. Such materials are often accompanied by auxiliary materials, such as fixatives, extenders, stabilizers and solvents. These auxiliaries are not included within the meaning of "perfume", as used herein. Typically, perfumes are complex mixtures of a plurality of organic compounds.

Preferably, the fabric softener composition comprises 0.01% to 3%, preferably 0.1% to 2%, more preferably 0.5% to 1%, by weight of the fabric softener composition, of the perfume.

The perfume herein may be a neat perfume and/or perfume delivery systems that can be combined to yield the desired scent experience from the store shelf stage of a product, through its total performance cycle. Suitable perfumes include those perfumes that are enduring perfumes and/or quadrant perfumes. Examples of such neat perfumes are disclosed in U.S. Pat. Nos. 5,500,138; 5,500,154; 6,491,728; 5,500,137 and 5,780,404. Suitable perfume delivery systems, methods of making certain perfume delivery systems and the uses of such perfume delivery systems are disclosed in US patent application No. 2007/0275866 A1.

Perfumes are typically mixtures of polar and non-polar oils. A composition comprising oils, even when some of these oils are polar, is not easily dispersed in a water continuous composition such as a fabric softener composition. Without wishing to be bound by theory, but a perfume must be finely subdivided in the continuous water phase of a fabric softening composition to enable adsorption of the perfume by the dispersed lamellar phase(s). One generally predicative measure of a perfume oil's dispersibility in water continuous compositions may include the perfume dielectronic constant. Perfumes with a lower dielectric constant, or the less polar perfumes, are more likely to be difficult to incorporate into fabric softener compositions comprising dispersed lamellar phases because such perfumes are more cohesive in an aqueous environment and thus require more mechanical energy to be subdivided in this environment. In one embodiment, the perfume composition of the present invention may have a combined dielectric constant below 12, or 11, or 10, or 9, or 8, or 6, or 5, or 4, alternatively greater than 1. The dielectronic constant can be measured by a Dielectric Constant Meter model 870 made by Scientifica.

Another generally predictive measure of a perfume's dispersibility in water continuous compositions may include a perfume ingredient's Log P that is the perfume ingredient's partition coefficient between water and octanol. One way of measuring Log P of a perfume ingredient is using the "C log P" program from BioByte Corp (e.g., C log P Version 4.0 and Manual 1999). C LOG P USER GUIDE, Version 4.0, BioByte Corp, (1999) is incorporated herein by reference. Another suitable way of measuring Log P is using the C LOG P program from Daylight Chemical Information Systems, Inc. of Aliso Viejo, Calif. The C LOG P Reference Manual, Daylight Version 4.9, Release Date Feb. 1, 2008, incorporated herein by reference. Without wishing to be bound by theory, but higher a perfume ingredient's Log P, the higher the ingredient's hydrophobicity, and the more difficult, e.g., more mechanical energy required, to incorporate the perfume ingredient in a fabric softener composition. A non-limiting set of perfumes ingredients that comprise a perfume are disclosed in U.S. Pat. No. 5,500,138, from column 7 line 42 to column 11 line 44. Perfume ingredients may also be suitably added as releasable fragrances, for example, as pro-perfumes or pro-fragrances as described in U.S. Pat. No. 5,652,205. In one embodiment, more than 25% of the perfume ingredients by weight of the perfume composition have a Log P higher than 2.5. Preferred embodiments include more than 35%, or more than 45%, or more than 50%, or more than 60%, or more than 70%, or more than 75% of perfume ingredients by weight of the perfume composition have a Log P higher than 2.5.

In another embodiment, the perfume may comprise at least 1, or 2, or 3, or 4, or 5, or 6, or 7, or 8, or 9, or 10, or 11, or 12, alternatively not greater than 100, different individual perfume ingredients.

In another preferred embodiment, the perfume is not pre-emulsified, i.e., prior to being added into the fabric softener active composition, the perfume is not mixed with other liquids that are normally immiscible with the perfume, e.g., an emulsifier. This differs from the common practice in the industry, in which typically, perfumes are emulsified before added to the fabric softener active composition.

Adjunct Ingredients

The continuous process of the present invention may comprise the step of adding one or more adjunct materials to the fabric softener active composition.

The adjunct materials herein may include: a perfume microcapsule, rheology modifier (e.g., Rheovis® available from BASF), stabilizer (e.g., Lupamin® available from BASF), pH control agent, metal ion control agent, colorant, brightener, dye, odor control agent, pro-perfume, cyclodextrin, solvent, soil release polymer, preservative (e.g., Proxel® GXL available from Arch Chemicals, Inc.), antimicrobial agent, chlorine scavenger, enzyme, anti-shrinkage agent, fabric crisping agent, silicone (e.g., PDMS), spotting agent, antioxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, anti-microbial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, enzymes, cationic starch, and mixtures thereof.

In one embodiment of the present invention, the fabric softener composition comprises one or more adjunct ingredients up to 2% by weight of the fabric softener composition. In another embodiment, the fabric softener composition of the present invention may be free or essentially free of any one or more adjunct ingredients. In yet another embodiment, the fabric softener composition is free or essentially free of detersive laundry surfactants.

Rheology Modifier

The adjunct materials herein may include a rheology modifier that builds viscosity to produce a preferred liquid gel product form. Suitable levels of the rheology modifier herein are in the range of from 0.001% to 10%, preferably from 0.1% to 3%, more preferably from 0.1% to 0.4% by weight of the fabric softener composition.

In one embodiment, the rheology modifiers suitable for use herein can be selected from thickening stabilizers. These include gums and other similar polysaccharides, for example gellan gum, carrageenan gum, xanthan gum, Diutan gum (available from CP Kelco) and other known types of thickeners and rheological additives such as Rheovis® CDP (available from BASF), Alcogum® L-520 (available from Alco Chemical), and Sepigel 305 (available from SEPPIC).

In another embodiment, cationic acrylic based homopolymers are utilized as the rheology modifier herein. One preferred example of such rheology modifier is sold under the name Rheovis® CDE by BASF.

Silicone

The adjunct materials herein may include a silicone. Silicones, not only provide softness and smoothness to fabrics, but also provide a substantial color appearance benefit to fabrics, especially after multiple laundry washing cycles. Without wishing to be bound by theory, it is believed that silicones provide an anti-abrasion benefit to fabrics in rinse cycles of an automatic washing machine by reducing friction of the fibers. Garments can look newer longer and can last longer before wearing out. Moreover, silicones can function as a suds suppressor when formulated in fabric softener compositions, thus reducing the number of rinse cycles required.

Suitable levels of the silicone herein are in the range of from 0.001% to 10%, preferably from 0.01% to 5%, more preferably from 0.1% to 3% by weight of the fabric softener composition.

The silicone suitable for use herein can be any silicone comprising compound. In one embodiment, the silicone is selected from an aminofunctional silicone, alkyloxylated silicone, ethoxylated silicone, propoxylated silicone, ethoxylated/propoxylated silicone, quaternary silicone, or mixtures thereof. In another embodiment, the silicone is a polydialkylsilicone, preferably a polydimethyl silicone ("PDMS"), or a derivative thereof.

In a preferred embodiment, the silicone is one comprising a relatively high molecular weight. A suitable way to describe the molecular weight of a silicone includes describing its viscosity. A high molecular weight silicone is one having a viscosity of from 1,000 cSt to 3,000,000 cSt, preferably from 6,000 cSt to 1,000,000 cSt, more preferably from 7,000 cSt to 1,000,000 cSt, even more preferably from 8,000 cSt to 350,000 cSt. In a preferred embodiment, the silicone is a PDMS or derivative thereof, having a viscosity from 30,000 cSt to 600,000 cSt, preferably from 75,000 cSt to 350,000 cSt, more preferably from 100,000 cSt to350,000 cSt. One example of a PDMS is DC 200 fluid from Dow Corning.

For purposes of describing the present invention, a suitable method to measure the viscosity of the silicone is the "Cone/Plate Method" as described herein. The viscosity is measured by a cone/plate viscometer (such as Wells-Brookfield cone/plate viscometer by Brookfield Engineering Laboratories, Stoughton, Mass.). Using the Cone/Plate Method, the spindle is "CP-52" and the revolutions per minute (rpm) are set at 5. The viscosity measurement is conducted at 21° C. Under the Cone/Plate Method, a typical PDMS fluid measured at 100,000 cSt will have an average molecular weight of 139,000. Without wishing to be bound by theory, the high molecular weight silicone is more viscous and is less easily rinsed off of the fabrics in the washing and/or rinsing cycles of an automatic washing machine.

In another embodiment, it has been surprisingly found that high molecular weight PDMS, verses low molecular weight PDMS, may be more effective in softening fabric. However, high molecular weight PDMS is viscous and thus difficult to handle from a processing perspective. Adding the viscous PDMS and an emulsifier into the fabric softener composition can result in inhomogeneous combination of the ingredients. Surprisingly, by using a high internal phase emulsion ("HIPE") as a premix, processing advantages are achieved. That is, by premixing a silicone, such as PDMS, and the emulsifier to create a HIPE, then adding this HIPE into the fabric softener composition, a homogeneous mixture may be achieved thereby. Thus, a composition that exhibits good fabric benefits can be achieved.

HIPEs herein generally are comprised of at least 65%, preferably at least 70%, more preferably at least 74%, even more preferably at least 80%; alternatively not greater than 95%, by weight of an internal phase, wherein the internal phase comprises a silicone. The internal phase can also be other water insoluble fabric care benefit agents that are not already pre-emulsified. The internal phase is dispersed by using an emulsifier. Preferred examples of the emulsifier include a surfactant or a surface tension reducing polymer. Another preferred emulsifier is water soluble and reduces the surface tension of water.

In one embodiment, HIPEs herein are prepared by first combining the oil phase (internal phase) and the emulsifier. Then the external phase is added slowly with moderate mixing to the combination of the oil phase and the emulsifier.

Stabilizer

The adjunct materials herein may include a stabilizer to further stabilize the fabric softener composition. Suitable levels of the stabilizer are in the range of from 0.001% to 5%, preferably from 0.01% to 1%, more preferably from 0.01% to 0.05%, by weight of the fabric softener composition.

Non-limiting examples of the stabilizers include water-soluble, low molecular weight primary and secondary amines of low volatility, e.g., monoethanolamine, diethanolamine, tris(hydroxymethyl)aminomethane, hexamethylenetetramine. Suitable amine-functional stabilizers include: water-soluble polyethyleneimines, polyamines, polyvinylamines, polyamineamides and polyacrylamides. The preferred polymers are polyethyleneimines, polyamines, and polyamineamides. Most preferably, the stabilizer is polyvinylamine, also known as Lupamin (e.g., Lupamin® 1595 and Lupamin® 5095 available from BASF).

Perfume Microcapsule

The adjunct materials herein may include a perfume microcapsule. Perfume microcapsules comprise a shell material and a core material of perfume that is encapsulated within the shell material. The perfume is substantially not being released from the microcapsules until the shell material ruptures because of a mechanical stress (e.g., friction). Perfume microcapsules are added into fabric softener compositions to provide improved delivery efficiency of perfume. Specifically, perfume capsules deposit onto fabrics during a rinse cycle. The perfume within perfume microcapsules is protected from volatilization to the surrounding air space for a prolonged duration of time. Such, perfume capsules, when deposited on fabrics, exhibit a burst of perfume upon rupturing.

Perfume microcapsules, typically having a diameter less than 300 microns, are generally well known. Microcapsules are described in the following references: US 2003/215417 A1; US 2003/216488 A1; US 2003/158344 A1; US 2003/165692 A1; US 2004/071742 A1; US 2004/071746 A1; US 2004/072719 A1; US 2004/072720 A1; EP 1,393,706 A1; US 2003/203829 A1; US 2003/195133 A1; US 2004/087477 A1; US 2004/0106536 A1; U.S. Pat. Nos. 6,645,479; 6,200,949; 4,882,220; 4,917,920; 4,514,461; U.S. RE 32,713; U.S. Pat. No. 4,234,627. Microcapsules may be prepared using a range of conventional methods known to those skilled in the art for making shell capsules, such as Interfacial polymerization, and polycondensation. See e.g., U.S. Pat. Nos. 3,516,941, 4,520,142, 4,528,226, 4,681,806, 4,145,184; GB 2,073,132; WO 99/17871; and MICROENCAPSULATION: Methods and Industrial Applications Edited by Benita and Simon (Marcel Dekker, Inc. 1996). It is recognized, however, that many variations with regard to materials and process steps are possible. Non-limiting examples of materials suitable for making shell of the microcapsule include urea-formaldehyde, melamine-formaldehyde, phenol-formaldehyde, gelatin, polyurethane, polyamides.

In one embodiment, the shell capsules typically have a mean diameter in the range of from 1 micrometer to 100 micrometers, preferably from 5 micrometers to 80 microns, more preferably from 10 micrometers to 75 micrometers, and even more preferably from 15 micrometers to 50 micrometers. The particle size distribution can be narrow, broad, or multimodal.

In another embodiment, microcapsules vary in size having a maximum diameter between 5 microns and 300 microns, preferably between 10 microns and 200 microns. As the capsule particle size approaches 300 microns, e.g. 250 microns, a reduction in the number of capsules entrained in the sheet 6 may be observed.

In another embodiment, the microcapsules utilized in the present invention generally have an average shell thickness ranging from 0.1 micron to 50 microns, alternatively from 1 micron to 10 microns.

Process

The continuous process of the present invention comprises the steps of:

a) adding a di(C6-C14)alkyl di(C1-C4 alkyl and/or hydroxyalkyl) quaternary in an amount of 0.01% to 1% by weight of the fabric softener composition and a perfume to a fabric softener active composition comprising 2% to 25% by weight of the fabric softener active composition of a bis-(2-hydroxyethyl)-dimethylammonium chloride fatty acid ester; and b) mixing the combination obtained in step a) by applying a shear of 1000 to 50000 $s^{-1}$, wherein in step a) the perfume and the di(C6-C14)alkyl di(C1-C4 alkyl and/or hydroxyalkyl) quaternary are added separately.

In step b) the mixing of the combination can be achieved via many devices, such as a rotor stator, a high shear mixer, etc. Preferably, the mixing of the combination is achieved via a high shear mixer, e.g., DISPAX-REACTOR® available from YKA. In another preferred embodiment, the shear applied in step b) is of from 5000 to 30000 $s^{-1}$. More preferably, the mixing of the combination is achieved via a high shear mixer by applying a shear of from 10000 to 20000 $s^{-1}$.

In a preferred embodiment, the process is in-line. The fabric softener active composition constitutes the base ingredients, and the finishing ingredients include the di(C6-C14)alkyl di(C1-C4 alkyl and/or hydroxyalkyl) quaternary, the perfume, and optionally the adjunct materials. The base ingredients flow through a line, and the finishing ingredients are added into the flow, to form finished products, namely, the fabric softener composition.

In another preferred embodiment, the di(C6-C14)alkyl di(C1-C4 alkyl and/or hydroxyalkyl) quaternary and the perfume are added to the fabric softener active composition via separate injections. More preferably, the separate injections for adding the di(C6-C14)alkyl di(C1-C4 alkyl and/or hydroxyalkyl) quaternary and the perfume are installed in an in-line process.

In yet another preferred embodiment, one or more adjunct materials are added before step b). Preferably, one of the adjunct materials is added via an injection that is separate from the injection that is used to inject the di(C6-C14)alkyl di(C1-C4 alkyl and/or hydroxyalkyl) quaternary. More preferably, the one of the adjunct materials is selected from the group consisting of rheology modifier, silicone, stabilizer, perfume microcapsule, and mixtures thereof. Even more preferably, each of the adjunct materials is added via separate injections.

In a highly preferred embodiment, the process herein comprises the steps of:

a) adding a didecyl dimethyl ammonium chloride in an amount of 0.01% to 1% by weight of the fabric softener composition, a perfume, and one or more adjunct materials to a fabric softener active composition comprising 2% to 25% by weight of the fabric softener active composition of a bis-(2-hydroxyethyl)-dimethylammonium chloride fatty acid ester, wherein at least one of the adjunct materials is selected from the group consisting of rheology modifier, silicone, stabilizer, perfume microcapsule, and mixtures thereof; and b) mixing the combination obtained in step a) by applying a shear of 1000 to 50000 $s^{-1}$, wherein in step a) the perfume, the didecyl dimethyl ammonium chloride, and the adjunct materials are added separately.

The process of the present invention provides a continuous process of making a stable fabric softener composition comprising di(C6-C14)alkyl di(C1-C4 alkyl and/or hydroxyalkyl) quaternary and perfume, i.e., the viscosity of the fabric softener composition does not increase significantly. Without wishing to be bound by theory, it is believed that formulating di(C6-C14)alkyl di(C1-C4 alkyl and/or hydroxyalkyl) quaternary into a fabric softener active composition in a continuous process leads to a reduced physical stability. Indeed, di(C6-C14)alkyl di(C1-C4 alkyl and/or hydroxyalkyl) quaternary self aggregates in micellar sized entities in the continuous process, and therefore destabilizes the fabric softener active composition caused by flocculation. The instability of fabric softener compositions is observed when either mixing di(C6-C14)alkyl di(C1-C4 alkyl and/or hydroxyalkyl) quaternary in presence of perfume ingredients suspended in fabric softener active compositions or premixing di(C6-C14)alkyl di(C1-C4 alkyl and/or hydroxyalkyl) quaternary and perfume. Indeed, under such conditions, the resulting fabric softener compositions demonstrate relatively high viscosity values with a change in viscosity observed upon storage of the fabric softener compositions. It is worth noting that when premixing di(C6-C14)alkyl di(C1-C4 alkyl and/or hydroxyalkyl) quaternary and perfume, the instability issue is even more severe since there appears to be an incompatibility between the ionic di(C6-C14)alkyl di(C1-C4 alkyl and/or hydroxyalkyl) quaternary and the hydrophobic perfume ingredients, which leads to a phase separation and an increase of viscosity. However, the applicant has surprisingly found that a stable fabric softener composition is obtained by adding di(C6-C14)alkyl di(C1-C4 alkyl and/or hydroxyalkyl) quaternary and perfume separately into a fabric softener active composition. This might be due to the reason that under such conditions, di(C6-C14)alkyl di(C1-C4 alkyl and/or hydroxyalkyl) quaternary aggregates with the perfume droplets, and thus does not form the micellar sized aggregates that lead to the flocculation. Thus, a more stable fabric softener composition is obtained even upon storage of the fabric softener composition.

EXAMPLES

The Examples herein are meant to exemplify the present invention but is not used to limit or otherwise define the scope of the present invention. Examples 3-6 are examples according to the present inventions, and Examples 7-14 are comparative examples.

Example 1

Formulations of Fabric Softener Compositions

The following compositions are made comprising the listed ingredients in the listed proportions (weight %).

| | 1A | 1B | 1C | 1D |
|---|---|---|---|---|
| bis-(2-hydroxyethyl)-dimethylammonium chloride fatty acid ester | 9.23% | 9.23% | 9.23% | 9.23% |
| Bardac ® 2250 a | 0.23% | 0.40% | 0.60% | 0.78% |
| Lupamin ® 1595 b | 0.01% | 0.01% | 0.01% | 0.01% |
| Rheovis ® CDE c | 0.30% | 0.30% | 0.30% | 0.30% |
| Dye | 0.00105% | 0.00105% | 0.00105% | 0.00105% |
| Perfume Microcapsule (% active) | 0.20% | 0.20% | 0.20% | 0.20% |
| Perfume | 0.7% | 0.7% | 0.7% | 0.7% |
| Water | Add to 100% | Add to 100% | Add to 100% | Add to 100% |

a Bardac ® 2250 is didecyl dimethyl ammonium chloride available from Lonza b Lupamin ® 1595 is polyvinylamine available from BASF.

c Rheovis ® CDE is cationic acrylic based polymer acting as a rheology modifier available from BASF.

Example 2

Formulations of Fabric Softener Compositions

The following composition is made comprising the listed ingredients in the listed proportions (weight %).

| | 2A | 2B | 2C | 2D |
|---|---|---|---|---|
| bis-(2-hydroxyethyl)-dimethylammonium chloride fatty acid ester | 9.23% | 9.23% | 9.23% | 9.23% |
| Bardac ® 2250 a | 0.23% | 0.40% | 0.60% | 0.78% |
| Perfume | 0.7% | 0.7% | 0.7% | 0.7% |
| Water | Add to 100% | Add to 100% | Add to 100% | Add to 100% |

a Bardac ® 2250 is didecyl dimethyl ammonium chloride available from Lonza

Example 3

In-Line Process of Making the Fabric Softener Composition of Example Composition 2A According to the Present Invention The In-line process comprises the steps of:

a) adding a didecyl dimethyl ammonium chloride and a perfume to a fabric softener active composition separately, the fabric softener active composition comprising 9.23% by weight of the fabric softener active composition of a bis-(2-hydroxyethyl)-dimethylammonium chloride fatty acid ester, the fabric softener composition comprising 0.23% by weight of the fabric softener composition of the didecyl dimethyl ammonium chloride, the fabric softener active composition constituting the base ingredients, and the perfume and the didecyl dimethyl ammonium chloride constituting the finishing ingredients; and b) mixing the combination obtained in step a) by applying a shear of 15000 $s^{-1}$.

Example 4

In-Line Process of Making the Fabric Softener Composition of Example Composition 2B According to the Present Invention The In-line process of making the fabric softener composition of Example Composition 2B is the same as in Example 3, except for the following: the didecyl dimethyl ammonium chloride is present at a level of 0.40% by weight of the fabric softener composition.

Example 5

In-Line Process of Making the Fabric Softener Composition of Example Composition 2C According to the Present Invention The In-line process of making the fabric softener composition of Example Composition 2C is the same as in Example 3, except for the following: the didecyl dimethyl ammonium chloride is present at a level of 0.60% by weight of the fabric softener composition.

Example 6

In-Line Process of Making the Fabric Softener Composition of Example Composition 2D According to the Present Invention The In-line process of making the fabric softener composition of Example Composition 2D is the same as in Example 3, except for the following: the didecyl dimethyl ammonium chloride is present at a level of 0.78% by weight of the fabric softener composition.

Comparative Example 7

Comparative In-Line Process A of Making the Fabric Softener Composition of Example Composition 2A The comparative In-line Process A comprises the steps of:

a) providing a fabric softener active composition comprising 9.23% by weight of the fabric softener active composition of a bis-(2-hydroxyethyl)-dimethylammonium chloride fatty acid ester, the fabric softener active composition constituting the base ingredients;

b) adding a perfume to the fabric softener active composition, the combination of the fabric softener active composition and the perfume constituting the base ingredients;

c) mixing the combination obtained in step b) by applying a shear of 15000 $s^{-1}$.

d) adding a didecyl dimethyl ammonium chloride to the mixed combination obtained in step c), and the didecyl dimethyl ammonium chloride constituting the finishing ingredients and being present at a level of 0.23% by weight of the fabric softener composition; and e) mixing the combination obtained in step d) with a static mixer.

Comparative Example 8

Comparative In-Line Process A of Making the Fabric Softener Composition of Example Composition 2B According to the Present Invention The In-line process of making the fabric softener composition of Example Composition 2B is the same as in Example 7, except for the following: the didecyl dimethyl ammonium chloride is present at a level of 0.40% by weight of the fabric softener composition.

Comparative Example 9

Comparative In-Line Process A of Making the Fabric Softener Composition of Example Composition 2C According to the Present Invention The In-line process of making the fabric softener composition of Example Composition 2C is the same as in Example 7, except for the following: the didecyl dimethyl ammonium is present at a level of 0.60% by weight of the fabric softener composition.

Comparative Example 10

Comparative In-Line Process A of Making the Fabric Softener Composition of Example Composition 2D According to the Present Invention The In-line process of making the fabric softener composition of Example Composition 2D is the same as in Example 7, except for the following: the didecyl dimethyl ammonium chloride is present at a level of 0.78% by weight of the fabric softener composition.

Comparative Example 11

Comparative Process B of Making the Fabric Softener Composition of Example Composition 2A The comparative In-line Process B comprises the steps of:

a) providing a fabric softener active composition comprising 9.23% by weight of the fabric softener active composition of a bis-(2-hydroxyethyl)-dimethylammonium chloride fatty acid ester, the fabric softener active composition constituting the base ingredients;

b) mixing a didecyl dimethyl ammonium chloride with a perfume, the mixture of the didecyl dimethyl ammonium chloride and perfume being the finishing ingredients;

c) adding the mixture of the didecyl dimethyl ammonium chloride and perfume to the fabric softener active composition, the didecyl dimethyl ammonium chloride being present at a level of 0.23% by weight of the fabric softener composition; and d) mixing the combination obtained in step c) by applying a shear of 15000 $s^{-1}$.

Comparative Example 12

Comparative In-Line Process B of Making the Fabric Softener Composition of Example Composition 2B According to the Present Invention The In-line process of making the fabric softener composition of Example Composition 2B is the same as in Example 11, except for the following: the didecyl dimethyl ammonium chloride is present at a level of 0.40% by weight of the fabric softener composition.

Comparative Example 13

Comparative In-Line Process B of Making the Fabric Softener Composition of Example Composition 2C According to the Present Invention The In-line process of making the fabric softener composition of Example Composition 2C is the same as in Example 11, except for the following: the didecyl dimethyl ammonium chloride is present at a level of 0.60% by weight of the fabric softener composition.

Comparative Example 14

Comparative In-Line Process B of Making the Fabric Softener Composition of Example Composition 2D According to the Present Invention The In-line process of making the fabric softener composition of Example Composition 2D is the same as in Example 11, except for the following: the didecyl dimethyl ammonium chloride is present at a level of 0.78% by weight of the fabric softener composition.

Comparative Data of Examples 3-14

A comparative experiment of assessing the stability, i.e., the viscosity of the fabric softener compositions obtained from the processes described in Examples 3-14, is conducted. Specifically, the viscosity of the fabric softener compositions is measured at the two time points, when they are freshly made and after storage for 1 week at 21° C.

The method of measuring the viscosity used herein is the "Cone/Plate Method" as described herein. The viscosity is measured by a cone/plate viscometer (such as Wells-Brookfield cone/plate viscometer by Brookfield Engineering Laboratories, Stoughton, Mass.). Using the Cone/Plate Method, the spindle is "CP-52" and the revolutions per minute (rpm) are set at 5. The viscosity measurement is conducted at 21° C. under the Cone/Plate Method.

As shown in FIG. 1, the fabric softener compositions obtained by the process according to the present invention (Examples 3-6), show higher degree of stability, i.e., the viscosity of the fabric softener compositions remains stable. Specifically, the viscosity of the fabric softener compositions being stored for 1 week demonstrates the same value of those made freshly. By contrast, the fabric softener compositions obtained by Process A (Examples 7-10) show a considerable viscosity increase after being stored for a week, especially at higher levels of didecyl dimethyl ammonium chloride. Moreover, the fabric softener compositions obtained by Process B (Examples 11-14) show the highest viscosity, even though the viscosity decreases after being stored for a week.

Moreover, it has been found that fabric softener compositions tend to become unstable when formulating higher levels of didecyl dimethyl ammonium chloride. However, as shown in FIG. 1, the fabric softener compositions obtained by the process according to the present invention do not experience a significant increase in viscosity when the level of didecyl dimethyl ammonium chloride increases from 0.23% to 0.78% by weight of the fabric softener compositions. By contrast, the fabric softener compositions obtained by Process A demonstrate a quite steep increase in viscosity when formulating more didecyl dimethyl ammonium chloride. Furthermore, the fabric softener compositions obtained by Process B demonstrate a much more steep increase in viscosity when formulating more didecyl dimethyl ammonium chloride.

Unless otherwise indicated, all percentages, ratios, and proportions are calculated based on weight of the total composition. All temperatures are in degrees Celsius (° C.) unless otherwise indicated. All component or composition levels are in reference to the active level of that component or composition, and are exclusive of impurities, for example, residual solvents or by-products, which may be present in commercially available sources.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A continuous process of making a fabric softener composition, wherein said process comprises the steps of:

a) adding a di(C6-C14)alkyl di(C1-C4 alkyl and/or hydroxyalkyl) quaternary in an amount of 0.01% to 1% by weight of said fabric softener composition and a perfume to a fabric softener active composition comprising 2% to 25% by weight of said fabric softener active composition of a bis-(2-hydroxyethyl)-dimethylammonium chloride fatty acid ester; and b) mixing the combination obtained in step a) by applying a shear of 15000 to 50000 $s^{-1}$, wherein in step a) said perfume and said di(C6-C14) alkyl di(C1-C4 alkyl and/or hydroxyalkyl) quaternary are added separately.

2. The process according to claim 1 wherein said process is in-line.

3. The process according to claim 2 wherein said perfume is not pre-emulsified.

4. The process according to claim 2 wherein said perfume and said di(C6 -C14)alkyl di(C1-C4 alkyl and/or hydroxyalkyl) quaternary are added via separate injections to said fabric softener active composition.

5. The process according to claim 1 wherein in step b) the mixing of the combination is achieved via a high shear mixer.

6. The process according to claim 2 wherein one or more adjunct materials are added before step b).

7. The process according to claim 6 wherein at least one of said one or more adjunct materials is added via an injection that is separate from the injection that is used to inject said di(C6-C14)alkyl di(C1-C4 alkyl and/or hydroxyalkyl) quaternary.

8. The process according to claim 7 wherein said one or more adjunct materials are selected from the group consisting of rheology modifier, silicone, stabilizer, perfume microcapsule, and mixtures thereof.

9. The process according to any one of preceding claims, wherein said di(C6 -C14)alkyl di(C1-C4 alkyl and/or hydroxyalkyl) quaternary is didecyl dimethyl ammonium chloride.

10. A fabric softener composition obtained by the process according to claim 1.

* * * * *